US008444450B2

(12) United States Patent
Shibahashi et al.

(10) Patent No.: US 8,444,450 B2
(45) Date of Patent: May 21, 2013

(54) METHOD FOR ALTERNATELY EXPRESSING COLOR-MEMORIZING PHOTOCHROMIC FUNCTION IN TOY ELEMENT, AND AN ALTERNATELY COLOR-MEMORIZING PHOTOCHROMIC TOY

(75) Inventors: Yutaka Shibahashi, Aichi (JP); Michiyuki Yasuda, Aichi (JP); Masahiro Irie, Fukuoka (JP)

(73) Assignee: The Pilot Ink Co., Ltd., Aichi (JP)

( * ) Notice: Subject to any disclaimer, the term of this patent is extended or adjusted under 35 U.S.C. 154(b) by 1982 days.

(21) Appl. No.: 10/694,006

(22) Filed: Oct. 28, 2003

(65) Prior Publication Data

US 2004/0135097 A1 Jul. 15, 2004

(30) Foreign Application Priority Data

Oct. 30, 2002 (JP) ..... P2002-315532
Sep. 4, 2003 (JP) ..... P2003-312179

(51) Int. Cl.
*A63H 30/00* (2006.01)

(52) U.S. Cl.
USPC ..... 446/175

(58) Field of Classification Search
USPC ..... 446/14, 219, 175; 252/586
See application file for complete search history.

(56) References Cited

U.S. PATENT DOCUMENTS

| | | | | |
|---|---|---|---|---|
| 2,460,221 | A * | 1/1949 | Gordon | 250/483.1 |
| 3,329,648 | A | 7/1967 | Chopoorian | |
| 4,134,853 | A | 1/1979 | Ehrlich et al. | |
| 4,503,177 | A * | 3/1985 | Reid et al. | 524/87 |
| 4,917,643 | A | 4/1990 | Hippely et al. | |
| 5,208,132 | A * | 5/1993 | Kamada et al. | 430/138 |
| 5,252,371 | A * | 10/1993 | Taniguchi et al. | 428/64.4 |
| 5,436,115 | A * | 7/1995 | Mullis | 430/338 |
| 5,581,090 | A | 12/1996 | Goudjil | |
| 2002/0114956 | A1 * | 8/2002 | Tomonaga et al. | 428/432 |

FOREIGN PATENT DOCUMENTS

| | | | |
|---|---|---|---|
| JP | 58-141172 | A | 8/1983 |
| JP | 60-171498 | U | 11/1985 |
| JP | 63-169199 | U | 11/1988 |
| JP | 4-24040 | A | 1/1992 |
| JP | 05-271649 | A | 10/1993 |
| JP | 6-57398 | U | 8/1994 |
| JP | 11-116565 | A | 4/1999 |
| WO | WO 02/064219 | A1 | 8/2002 |

OTHER PUBLICATIONS

European Search Report dated Dec. 15, 2003.

* cited by examiner

*Primary Examiner* — Gene Kim
*Assistant Examiner* — Alyssa Hylinski
(74) *Attorney, Agent, or Firm* — Sughrue Mion, PLLC

(57) ABSTRACT

A toy comprises a toy element comprising a photochromic layer which contains a photochromic compound having a photo memory function (color-memorizing photochromic property), maintains a coloring state by developing a color through the irradiation of ultraviolet rays or sunlight containing ultraviolet rays and changes into decolorizing state through its decolorization by the irradiation of visible light, and a color-changing means which contains at least one of an ultraviolet ray absorbent and a light-shading pigment capable of shading at least ultraviolet rays, changes the photochromic compound of the coloring state into decolorizing state by cutting off ultraviolet rays of sunlight and thereby effecting irradiation of visible light, and maintains the changed state, wherein a function to memorize and maintain coloring and decolorizing states alternately is expressed by arranging the color-changing means under such a condition that it is contacted or non-contacted with the photochromic layer.

15 Claims, 4 Drawing Sheets

METHOD FOR ALTERNATELY EXPRESSING COLOR-MEMORIZING PHOTOCHROMIC FUNCTION IN TOY ELEMENT, AND AN ALTERNATELY COLOR-MEMORIZING PHOTOCHROMIC TOY

BACKGROUND OF THE INVENTION

1. Field of the Invention

This invention relates to a method for alternately expressing a color-memorizing photochromic function in a toy element, and an alternately color-memorizing photochromic toy.

2. Description of the Related Art

As toys which change color, thermochromic toys which use thermochromic materials and photochromic toys that use photochromic materials are conventionally known.

As the aforementioned thermochromic toy, doll toys, bath toys and the like which change color by the application of heating or cooling means (e.g., hair dryer, temperature of a bath, cool water and the like) have been on the commodity market.

On the other hand, the photochromic toy does not require heating or cooling means, but uses a photochromic material which changes color by the irradiation of sunlight, so that it has an advantage in that babies and the like can use it easily and safely in color-changing play, and several proposals have been disclosed (e.g., see JP-A-58-141172, JP-A-4-24040, JP-UM-A-60-171498, JP-UM-A-63-169199 and JP-UM-A-6-57398)

SUMMARY OF THE INVENTION

The conventional photochromic toys are produced making use of a type of photochromic material which changes color by the irradiation of sunlight and returns to the original color spontaneously and alternately when left on a place where it is not exposed to sunlight, so that they do not have the ability to alternately memorize changes in color and therefore do not satisfy their properties as toys and diversity of application and development as toys.

Taking the aforementioned circumstances into consideration, the present inventors have conducted intensive studies and, during the process of examining applicability of thermally irreversible photochromic compounds considered to be necessary for optical memory (color-memorizing photochromic property) to toy elements, have found a convenient method for obtaining a toy having a property to alternately memorize and maintain coloring state and decolorizing state, thus resulting in the accomplishment of the invention.

For the purpose of realizing the aforementioned method, the invention contemplates providing a novel method for alternately expressing a color-memorizing photochromic function in a toy element and an alternately color-memorizing photochromic toy, which satisfy the properties as toys and diversity of application and development as toys, effected by employing a specified photochromic compound as a photochromic material and arranging a specified color-changing means on a specified position, and thereby effecting expression of the characteristics of the aforementioned photochromic compound effectively as toy use and expression of the function to alternately memorize and maintain coloring state and decolorizing state.

A first requirement of the invention is a method for alternately expressing a color-memorizing photochromic function in a toy element, which comprises arranging (1) a color-changing means under a contacted or non-contacted condition, which contains at least one of an ultraviolet ray absorbent and a light-shading pigment capable of shading at least ultraviolet rays, to (2) a toy element comprising a photochromic layer which maintains a coloring state by developing a color through the irradiation of ultraviolet rays or sunlight containing ultraviolet rays and changes into decolorizing state through its decolorization by the irradiation of visible light, wherein the color-changing means changes the photochromic layer of the coloring state into decolorizing state by cutting off ultraviolet rays of sunlight and thereby effecting irradiation of visible light, and maintains the changed state, so as to express a function to memorize and maintain coloring and decolorizing states alternately.

Other requirements are that the photochromic layer contains a diaryl ethene photochromic compound.

A second requirement of the invention is an alternately color-memorizing photochromic toy comprising: a toy element comprising a photochromic layer which contains a diaryl ethene photochromic compound, maintains a coloring state by developing a color through the irradiation of ultraviolet rays or sunlight containing ultraviolet rays and changes into decolorizing state through its decolorization by the irradiation of visible light; and a color-changing means which contains at least one of an ultraviolet ray absorbent and a light-shading pigment capable of shading at least ultraviolet rays, changes said photochromic compound of the coloring state into decolorizing state by cutting off ultraviolet rays of sunlight and thereby effecting irradiation of visible light, and maintains the changed state, wherein a function to memorize and maintain coloring and decolorizing states alternately is expressed by arranging said color-changing means under such a condition that it is contacted or non-contacted with said photochromic layer.

Other requirements are that the diaryl ethene photochromic compound is included in microcapsules, that the photochromic layer is any one of a printing or coating layer, a printing image and a writing image, which contains at least a diaryl ethene photochromic compound and a binder resin, that photochromic layer is a compact prepared by integrally blending a diaryl ethene photochromic compound with a thermoplastic resin, that the color-changing means is a sheet-shaped compact prepared by integrally blending at least one of an ultraviolet ray absorbent and a light-shading pigment capable of shading at least ultraviolet rays with a transparent plastic, that a rapping image is arranged inside of the sheet-shaped compact, that the color-changing means is any one of a printing or coating layer, a printing image and a writing image, wherein at least one of an ultraviolet ray absorbent and a light-shading pigment capable of shading at least ultraviolet rays is fixed in a dissolved or dispersed state to a binder resin, that any one of a printing or coating layer, a printing image and a writing image is directly arranged on the photochromic layer of a toy element, that any one of a printing or coating layer, a printing image and a writing image is arranged on a transparent plastic sheet, that the color-changing means is a paste-like form in which at least one of an ultraviolet ray absorbent and a light-shading pigment capable of shading at least ultraviolet rays is dissolved or dispersed, that the color-changing means is a cloth constituted from transparent fibers prepared by fixing at least one of an ultraviolet ray absorbent and a light-shading pigment capable of shading at least ultraviolet rays on the surface or by blending therewith, that the color-changing means is a visible light irradiator whose main light generation range is in the visible light, that the coloring state is changed by an ultraviolet ray irradiator which irradiates ultraviolet rays, and that a general purpose dyestuff or pigment is allowed to coexist in the photochromic layer.

DETAILED DESCRIPTION OF THE INVENTION

Figure 1:
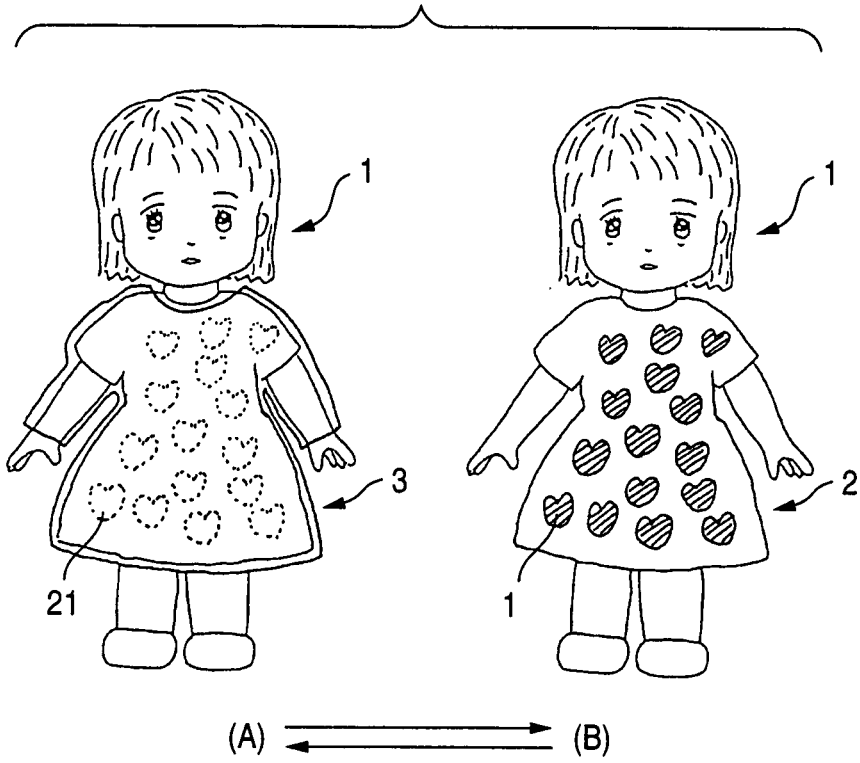
FIG. 1 is an explanatory drawing showing a decolorized state (A) of the alternately color-memorizing photochromic toy (doll toy) of the invention at the time of applying a color-changing means (a coat) and a colored state (B) at the time of not applying aforementioned color-changing means (a coat), wherein both of the aforementioned states [(A) and (B)] are under an alternately memory-maintained condition.

The aforementioned photochromic layer is effective when it contains a photochromic compound having a light-memorizing property (color-memorizing photochromic property).

As the aforementioned photochromic compound, a fulgide compound, a diaryl ethene compound and the like can be employed.

As the fulgide compound, dimethylaminoindolyl fulgide, furyl fulgide, thienyl fulgide and the like can be exemplified.

The aforementioned diaryl ethene compound is a photochromic material having markedly improved thermal irreversibility, repetitive durability, long-wave range sensitivity, high sensitivity and the like and is particularly effective as toy use.

Examples of the aforementioned diaryl ethene photochromic compound are shown below, but the diaryl ethene photochromic compounds to be used in the invention are not limited to the following compounds.

Compounds represented by a general formula (1) can be cited as the basal nucleus of the diaryl ethene photochromic compound.

(1)

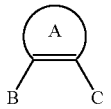

Ring A of the aforementioned general formula (1) represents a hydrocarbon ring or heterocyclic ring which may be in the form of fluoride (fluoro compound)- or perfluoro compound.

Compounds represented by the aforementioned general formula (1) are illustratively exemplified with reference to a general formula (2) or (3).

(2)

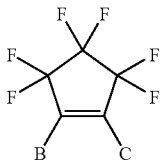

The compound represented by the aforementioned general formula (2) has a ring containing 5 carbon atoms which may be in the form of fluoride or perfluoro compound.

(3)

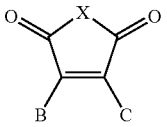

The compound represented by the aforementioned general formula (3) forms an anhydrous ring containing 4 carbon atoms, and X represents oxygen atom or an NR group (wherein R is an alkyl group and/or hydroxyl alkyl group having from 2 to 16 carbon atoms).

In addition, compounds represented by a general formula (4) can be cited as the basal nucleus of another diaryl ethene photochromic compounds.

(4)

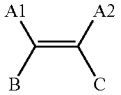

Group A1 and group A2 of the compounds represented by the aforementioned general formula (4) always take cis-form against the double bond, and each independently represents substituted or unsubstituted alkyl group, fatty acid ester group or nitrile group.

The compounds represented by the aforementioned general formula (4) are illustratively exemplified with reference to a general formulae (5) and (6).

(5)

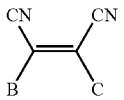

(6)

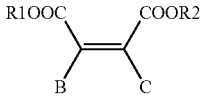

R1 and R2 of the compounds represented by the aforementioned general formula (6) represent methyl group or ethyl group, respectively.

Group B and group C in the compounds represented by the aforementioned general formulae (1) to (6) may be the same or different from each other, and its illustrative examples include groups represented by the following structural formulae.

(7)

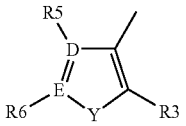

(8)

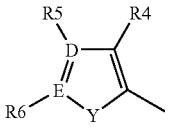

(9)

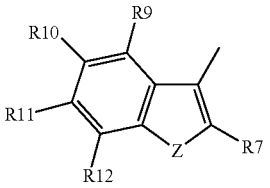

(10)

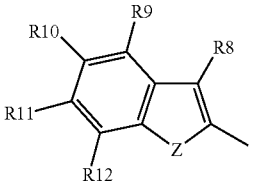

(11)

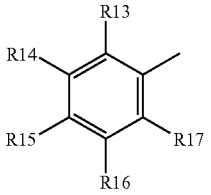

[In these formulae, Y and Z may be the same or different from each other and each represents oxygen atom or sulfur atom or oxidized form of sulfur, nitrogen or selenium, and D and E may be the same or different from each other and each represents carbon atom or nitrogen atom, R3 to R17 may be the same or different from one another and each represents hydrogen, a linear or branched chain alkyl or alkoxy group having from 1 to 16 carbon atoms, a halogen atom, a linear or branched chain fluoro or perfluoro group having from 1 to 4 carbon atoms, carboxylate group, an alkyl carboxylate group having from 1 to 16 carbon atoms, a mono- or di-alkylamino group having from 1 to 16 carbon atoms, nitrile group, phenyl group, naphthalene group or a heterocyclic compound (pyridine, quinoline, thiophene, furan, indole, pyrrole, selenophene, thiazole, benzothiophene or the like). However, when D is nitrogen atom, R5 is not present. As well, when E is nitrogen atom, R6 is not present. Between double bond and groups B and C, a group other than hydrogen, e.g., $CH_3$, CN or $CO_3C_2H_5$, must be present always at the ortho position against the bond, R3 or R4 must be other than hydrogen, and R7 or R8 must be other than hydrogen in the same manner. Regarding R13 to R17, they may be naphthalene nucleus formed by bonding the ring with an adjacent group.]

The following can be cited as further illustrative examples of the aforementioned group B and group C.

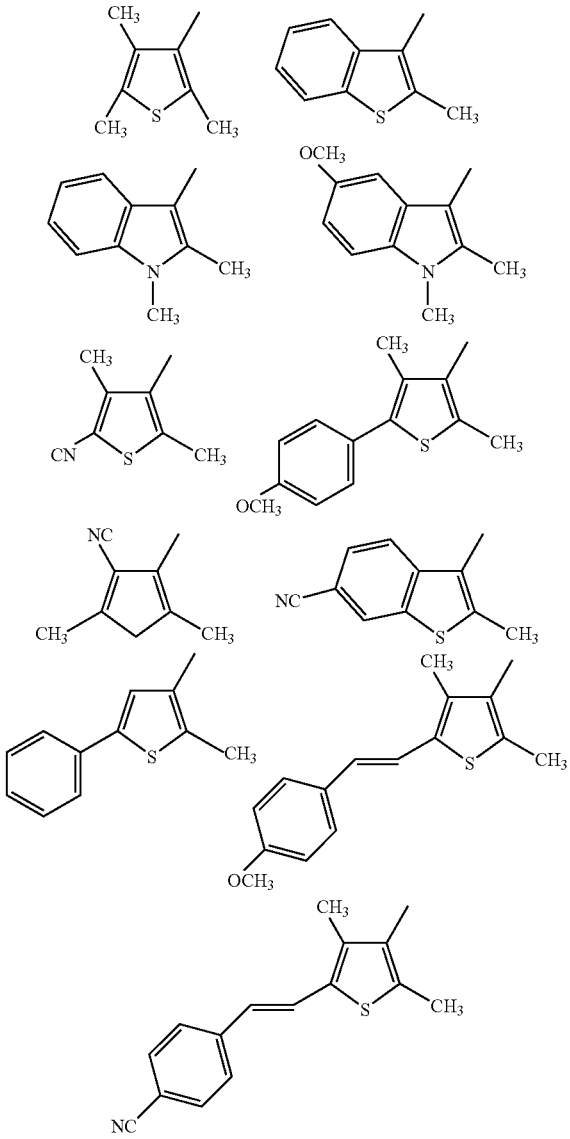

-continued
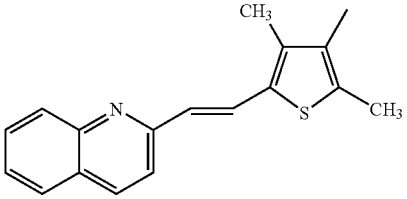
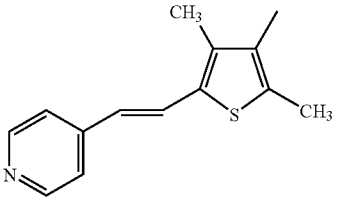
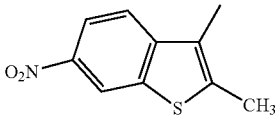
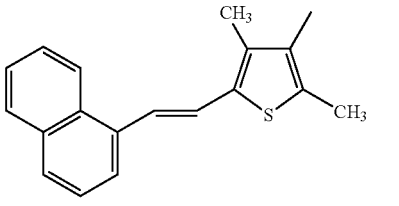
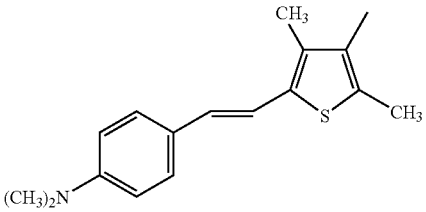
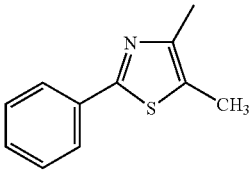
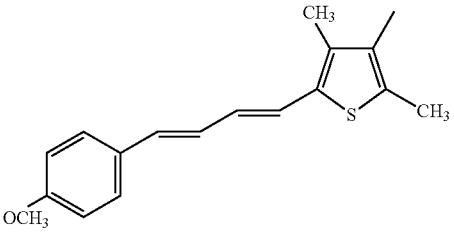
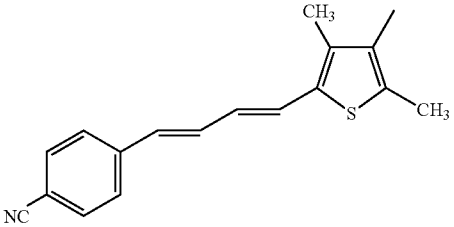
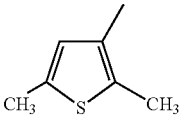
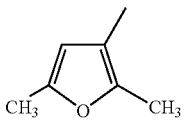
-continued
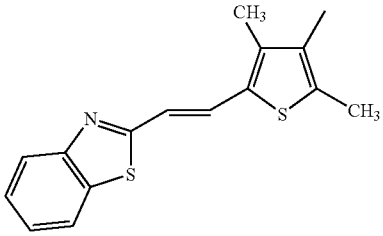
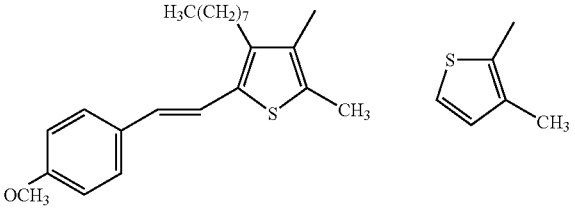
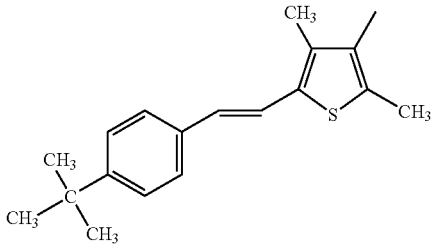
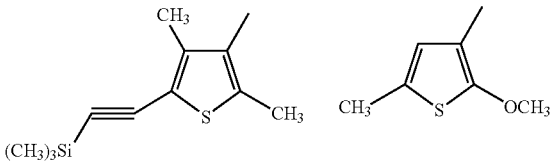
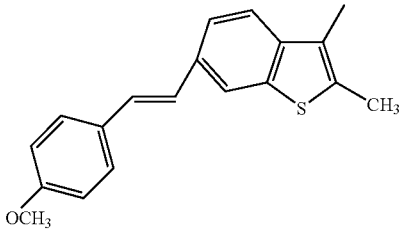
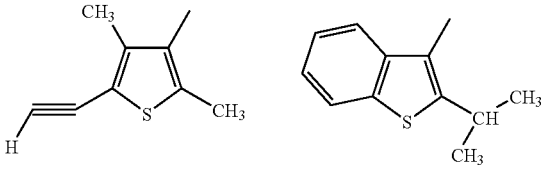
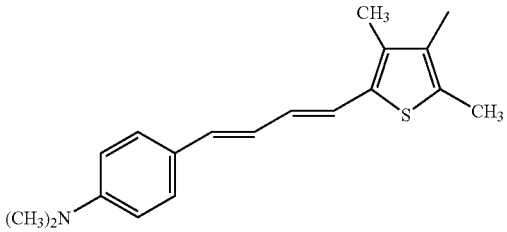
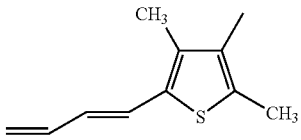
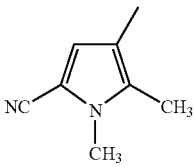

-continued
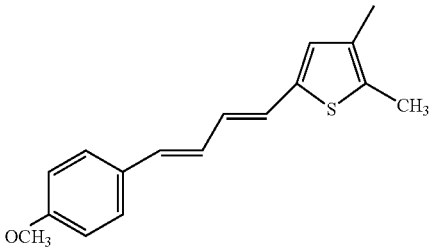
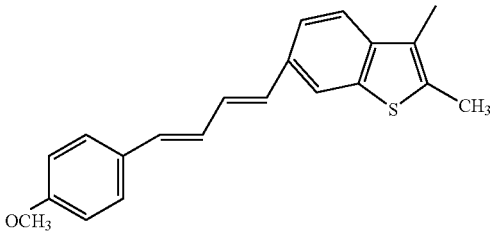
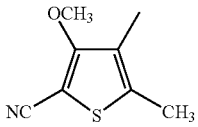
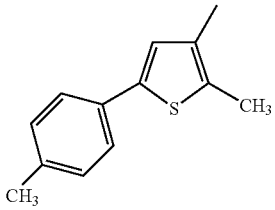
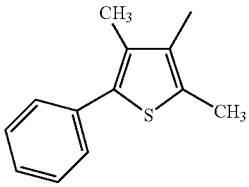
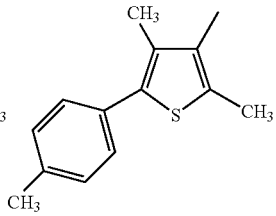
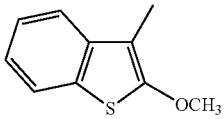
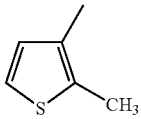
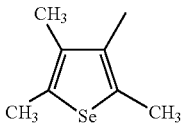
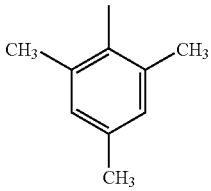
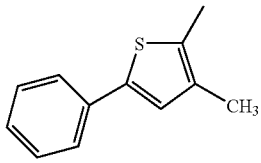
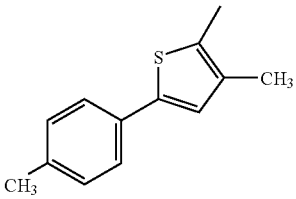
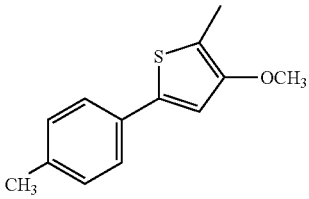
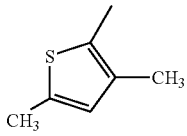
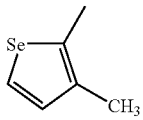
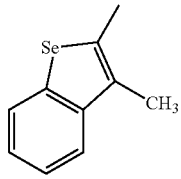
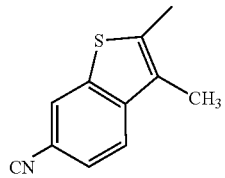
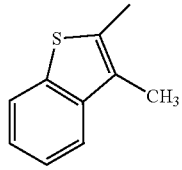
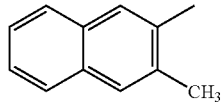
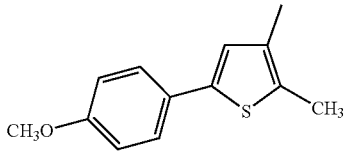
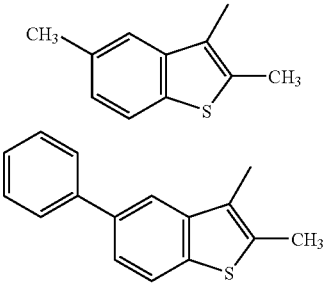
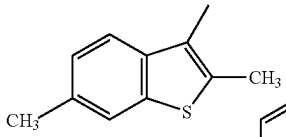
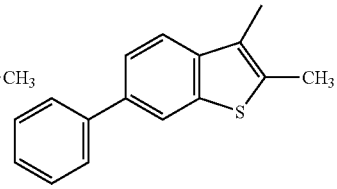
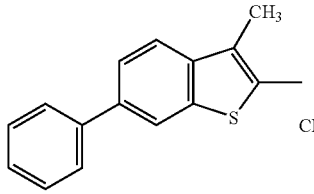
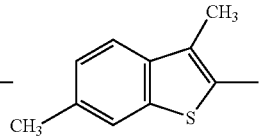
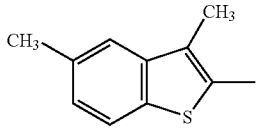
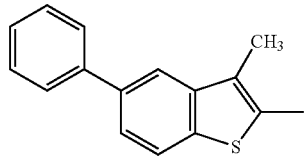
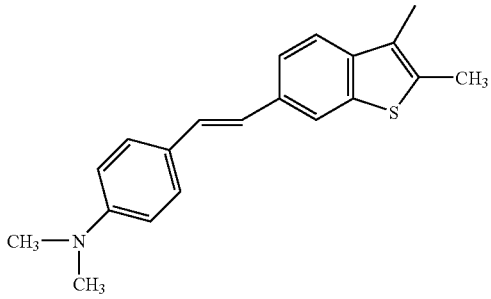
In further illustratively describing the compounds represented by the aforementioned general formula (2) or (3), 3,4-bis(1,2-dimethyl-3-indolyl)furan-2,5-dion, 3,4-di(2-methyl-3-benzothiophene) furan-2,5-dion and the like can be exemplified as the maleic anhydride compound.

Examples of the cyclopentene compound include 1-(1,2-dimethylindolyl)-2-(2-cyano-3,5-dimethyl-4-thienyl)-3,3,4,4,5,5-hexafluorocyclopentene,
1-(1,2-dimethyl-3-indolyl)-2-(3-cyano-2,5-dimethyl-4-thienyl)-3,3,4,4,5,5-hexafluorocyclopentene,
1-(1,2-dimethyl-3-indolyl)-2-(2-methyl-3-benzothienyl)-3,3,4,4,5,5-hexafluorocyclopentene,
1,2-bis(5-(4-methoxyphenyl)-2,4-dimethyl-3-thienyl)-3,3,4,4,5,5-hexafluorocyclopentene,
1,2-bis(5-(2-(4-methoxyphenyl)-1-ethenyl)-2,4-dimethyl-3-thienyl)-3,3,4,4,5,5-hexafluorocyclopentene,
1,2-bis(5-(2-(4-cyanophenyl)-1-ethenyl)-2,4-dimethyl-3-thienyl)-3,3,4,4,5,5-hexafluorocyclopentene,
1,2-bis(2,4-dimethyl-5-(2-(2-quinolyl)-1-ethenyl)-3-thienyl)-3,3,4,4,5,5-hexafluorocyclopentene,
1,2-bis(2,4-dimethyl-5-(2-(4-pyridyl)-1-ethenyl)-3-thienyl)-3,3,4,4,5,5-hexafluorocyclopentene,
1,2-bis(2,4-dimethyl-5-(2-(1-naphthyl)-1-ethenyl)-3-thienyl)-3,3,4,4,5,5-hexafluorocyclopentene,
1,2-bis(5-(2-(4-methoxyphenyl)-1-ethenyl)-2-methyl-4-octyl-3-thienyl)-3,3,4,4,5,5-hexafluorocyclopentene,
1,2-bis(5-(2-(4-t-butylphenyl)-1-ethenyl)-2,4-dimethyl-3-thienyl)-3,3,4,4,5,5-hexafluorocyclopentene,
1,2-bis(2,4-dimethyl-5-(2-(2-benzothiazyl)-1-ethenyl)-3-thienyl)-3,3,4,4,5,5-hexafluorocyclopentene,
1-(6-(2-(4-methoxyphenyl)-1-ethenyl)-2-methyl-3-benzothienyl)-2-(5-(4-(4-dimethylaminophenyl)-1,3-butadienyl)-2,4-dimethyl-3-thienyl)-3,3,4,4,5,5-hexafluorocyclopentene,
1-(6-(4-(4-methoxyphenyl)-1,3-butadienyl)-2-methyl-3-benzothienyl)-2-(5-(4-(4-methoxyphenyl)-1,3-butadienyl)-2,4-dimethyl-3-thienyl)-3,3,4,4,5,5-hexafluorocyclopentene,
1,2-bis(6-(4-(4-methoxyphenyl)-1,3-butadienyl)-2-methyl-3-benzothienyl)-3,3,4,4,5,5-hexafluorocyclopentene,
1,2-bis(6-(2-(4-methoxyphenyl)-1-ethenyl)-2-methyl-3-benzothienyl)-3,3,4,4,5,5-hexafluorocyclopentene,
1-(6-(2-(4-dimethylaminophenyl)-1-ethenyl)-2-methyl-3-benzothienyl)-2-(5-(2-(4-cyanophenyl)-1-ethenyl)-2,4-dim ethyl-3-thienyl)-3,3,4,4,5,5-hexafluorocyclopentene,
1-(6-(2-(4-methoxyphenyl)-1-ethenyl)-2-methyl-3-benzothienyl)-2-(5-(2-(4-cyanohenyl)-1-ethenyl)-2,4-dimethyl-3-thienyl)-3,3,4,4,5,5-hexafluorocyclopentene,
1-(6-(2-(4-methoxyphenyl)-1-ethenyl)-2-methyl-3-benzothienyl)-2-(5-(2-(4-methoxyphenyl)-1-ethenyl)-2,4-dimethyl-3-thienyl)-3,3,4,4,5,5-hexafluorocyclopentene,
1-(6-(4-(4-methoxyphenyl)-1,3-butadienyl)-2-methyl-3-benzothienyl)-2-(5-(2-(4-methoxyphenyl)-1-ethenyl)-2,4-di methyl-3-thienyl)-3,3,4,4,5,5-hexafluorocyclopentene,
1-(6-(2-(4-methoxyphenyl)-1-ethenyl)-2-methyl-3-benzothienyl)-2-(2,4-dimethyl-(5-(4-(4-methoxyphenyl)-1,3-butadienyl)-3-thienyl)-3,3,4,4,5,5-hexafluorocyclopentene,
1-(1,2-dimethyl-3-indolyl)-2-(2-cyano-3-methoxy-5-methylthienyl)-3,3,4,4,5,5-hexafluorocyclopentene,
1,2-bis(2-methyl-5-phenyl-3-thienyl)-3,3,4,4,5,5-hexafluorocyclopentene,
1,2-bis(2,4-dimethyl-5-phenyl-3-thienyl)-3,3,4,4,5,5-hexafluorocyclopentene,
1,2-bis(5-methyl-2-phenyl-4-thienyl)-3,3,4,4,5,5-hexafluorocyclopentene,
1,2-bis(2-methylbenzothiophen-3-yl)-3,3,4,4,5,5-hexa fluorocyclopentene,
1,2-bis(3-methylbenzothiophen-2-yl)-3,3,4,4,5,5-hexafluorocyclopentene,
1,2-bis(3-methyl-2-thienyl)-3,3,4,4,5,5-hexafluorocyclopentene,
1,2-bis(2-methyl-6-nitro-3-benzothienyl)-3,3,4,4,5,5-hexafluorocyclopentene,
1-(3-methyl-2-thienyl)-2-(2-methyl-3-thienyl)-3,3,4,4,5,5-hexafluorocyclopentene,
1,2-bis(5-(4-methylphenyl)-2-methyl-3-thienyl)-3,3,4,4,5,5-hexafluorocyclopentene,
1-(2,4-dimethyl-5-phenyl-3-thienyl)-2-(2-methyl-5-phenyl-3-thienyl)-3,3,4,4,5,5-hexafluorocyclopentene,
1,2-bis(2,4-dimethyl-5-(4-methoxyphenyl)-3-thienyl)-3,3,4,4,5,5-hexafluorocyclopentene,
1-(2-methyl-S-(4-methylphenyl)-3-thienyl)-2-(2,4-dim ethyl-5-(4-methylphenyl)-3-thienyl)-3,3,4,4,5,5-hexafluorocyclopentene,
1-(2-methyl-5-(4-methoxyphenyl)-3-thienyl)-2-(2,4-dimethyl-5-(4-methylphenyl)-3-thienyl)-3,3,4,4,5,5-hexafluorocyclopentene,
1-(3-methyl-2-thienyl)-2-(S-methyl-2-phenyl-4-thiazoyl)-3,3,4,4,5,5-hexafluorocyclopentene,
1-(3-methylbenzothiophen-2-yl)-2-(5-methyl-2-phenyl-4-thiazoyl)-3,3,4,4,5,5-hexafluorocyclopentene,
1-(3-methylbenzothiophen-3-yl)-2-(5-methyl-2-phenyl-4-thiazoyl)-3,3,4,4,5,5-hexafluorocyclopentene,
1-(2-methyl-5-methyl-benzothiophen-3-yl)-2-(5-methyl-2-phenyl-4-thiazoyl)-3,3,4,4,5,5-hexafluorocyclopentene,
1-(2-methyl-5-phenyl-benzothiophen-3-yl)-2-(5-methyl-2-phenyl-4-thiazoyl)-3,3,4,4,5,5-hexafluorocyclopentene,
1-(3-methyl-5-methyl-benzothiophen-2-yl)-2-(5-methyl-2-phenyl-4-thiazoyl)-3,3,4,4,5,5-hexafluorocyclopentene,
1-(3-methyl-5-phenyl-benzothiophen-2-yl)-2-(5-methyl-2-phenyl-4-thiazoyl)-3,3,4,4,5,5-hexafluorocyclopentene,
1-(3-methyl-6-methyl-benzothiophen-2-yl)-2-(5-methyl-2-phenyl-4-thiazoyl)-3,3,4,4,5,5-hexafluorocyclopentene,
1-(3-methyl-6-phenyl-benzothiophen-2-yl)-2-(5-methyl-2-phenyl-4-thiazoyl)-3,3,4,4,5,5-hexafluorocyclopentene,
1-(2-methyl-6-methyl-benzothiophen-3-yl)-2-(5-methyl-2-phenyl-4-thiazoyl)-3,3,4,4,5,5-hexafluorocyclopentene,
1-(2-methyl-6-phenyl-benzothiophen-3-yl)-2-(5-methyl-2-phenyl-4-thiazoyl)-3,3,4,4,5,5-hexafluorocyclopentene,
1-(2-phenyl-5-methyl-4-thiazoyl)-2-(3-methyl-2-thienyl)-3,3,4,4,5,5-hexafluorocyclopentene and the like.

In further illustratively describing the compounds represented by the aforementioned general formula (5) or (6), dimethyl 2,3-di(2-methylbenzothienyl)-maleate and the like can be exemplified as the maleic acid compound.

Examples of the dicyanoethylene compound include 1,2-bis(2,3,5-trimethyl-4-thienyl)-1,2-dicyanoethylene, 1,2-bis(2-methyl-3-benzothienyl)-1,2-dicyanoethylene and the like.

The aforementioned diaryl ethene photochromic compound can be subjected to practical use as its direct dyestuff form, as a resin powder containing the aforementioned compound or as a pigment of microcapsule form in which the aforementioned compound is included in microcapsules together with a medium such as water, organic solvent and the like, and a printing ink, a paint, an ink for stamp use or an ink for writing implements use can be prepared by blending it with a vehicle containing a fixing agent selected from generally used binder resins such as various synthetic resin emulsions, water-soluble or oil-soluble synthetic resins, sizing agents and the like.

In this connection, the aforementioned pigment of microcapsule form can be obtained by an optional method such as the conventionally known interfacial polymerization, in situ polymerization, submerged interfacial polymerization, spray drying or the like method, and those having a particle diameter of approximately from 0.5 to 50 am, preferably from 1 to 30 μm, are effective in view of dispersibility, durability and workability.

Examples of the photochromic layer include a printing or coating layer (including an image) formed on the substrate surface by the aforementioned printing ink or paint, an image by an ink for stamp use or a printing image by an ink for writing implements use. Regarding thickness of the aforementioned printing or coating layer, printing image or writing image, a range of from 3 μm to 400 μm, preferably from 5 μm to 300 μm, is practical.

In addition, a photochromic layer may also be obtained by integrally blending the aforementioned dyestuff, resin powder or microencapsulated pigment with a thermoplastic resin to form a compact having a sheet shape, filament shape or other optional shape, and using its surface layer as the photochromic layer.

Regarding amount of the aforementioned diaryl ethene photochromic compound to be contained in the photochromic layer, a range of from 0.005 to 20% by weight, preferably from 0.01 to 10% by weight, is practical and satisfies toy properties.

When the content is less than 0.005% by weight, it is difficult to satisfy visual effect by photochromism due to low coloring density. On the other hand, when the content exceeds 20% by weight, the coloring density effect corresponding to the content cannot be obtained. The visual effect can be further improved by allowing a generally used dyestuff or pigment to coexist in the aforementioned photochromic layer and thereby effecting colorful changes in color at the time of coloring and at the time of decolorization.

Examples of the base substance of the aforementioned toy element include a doll, an animal, a plant, a vehicle, a building and the like figuration toys which by themselves have toy figurations, belongings of the aforementioned figuration toys (e.g., a hat, a wig, false hair, shoes, a bag, eyeglasses, clothing, an umbrella, an artificial flower, a pot and the like), accessories for dolls (a crown, a tiara, a necklace, a ring, a bracelet, a brooch, earrings and the like), game elements (a jigsaw puzzle and the like), plastic or fluid materials of clay, gel substance and the like, and teaching or magical elements which use characteristics of color change.

The toy element is constructed by arranging a photochromic layer on the aforementioned base substance, and its coloring is effected and the coloring state is maintained by its exposure to ultraviolet rays by an ultraviolet ray irradiator equipped with an ultraviolet ray-generating lamp, a light emitting diode or the like light source, or to sunlight containing ultraviolet rays.

The color-changing means contains at least one of an ultraviolet ray absorbent and a light-shading pigment capable of shading at least ultraviolet rays, which is a means for changing the aforementioned photochromic compound of the coloring state into decolorizing state by cutting off ultraviolet rays of sunlight and thereby effecting irradiation of visible light and maintaining the changed state, and its examples include compacts having a sheet shape, filament shape or other optional figuration, formed by integrally blending at least one of conventionally and generally used ultraviolet ray absorbent and light-shading pigment with a thermoplastic resin such as a transparent plastic resin.

In this connection, in the case of the aforementioned sheet-shaped and thin compacts, the visual effect by the comparison of coloring image with decolorizing image can be improved by rapping a letter, design, pattern or the like image inside thereof.

Also, the aforementioned color-changing means may be those in which a printing or coating layer (including an image), a printing image or a writing image prepared by fixing at least one of an ultraviolet ray absorbent and a light-shading pigment to a binder resin in a dissolved or dispersed state is arranged on a support comprising a transparent or opaque sheet, a compact of optional figuration or the like, or those in which the aforementioned printing or coating layer, printing image or writing image is directly arranged on the photochromic layer of a toy element.

In addition, the aforementioned color-changing means may be textile, knitting, braiding, nonwoven fabric or the like cloth having flexibility constituted from transparent fibers prepared by fixing at least one of an ultraviolet ray absorbent and a light-shading pigment capable of shading at least ultraviolet rays on the surface or by blending therewith.

Regarding the aforementioned transparent fibers, since single yarn can effectively cut ultraviolet rays, textiles produced by using single yarn-like transparent fibers in the warp or the weft or both of them are suitable.

In addition, the color-changing means may be in the form of plastic or fluid material such as a paste, gel or the like, blended with at least one of an ultraviolet ray absorbent and a light-shading pigment.

When an ultraviolet ray absorbent is blended with the aforementioned thermoplastic resin, effective ultraviolet ray cutting function is exerted by blending 0.001% by weight or more, preferably 0.01% by weight or more, based on the resin weight, of the ultraviolet ray absorbent.

In addition, when a fixing layer (including an image) is formed by an ink prepared by dissolving or dispersing an ultraviolet ray absorbent in a vehicle containing a binder resin, effective ultraviolet ray cutting function is exerted by blending 0.05% by weight or more, preferably 0.1% by weight or more, based on the binder resin, of the ultraviolet ray absorbent.

On the other hand, when a light-shading pigment is blended, desired ultraviolet ray-cutting effect is exerted by blending it in an amount of from 0.1 to 40% by weight, preferably from 1 to 30% by weight, based on the aforementioned thermoplastic resin or binder resin, and fixing it in a dispersed state.

Examples of the aforementioned ultraviolet ray absorbent include 2,4-dihydroxybenzophenone,
2-hydroxy-4-methoxybenzophenone,
2,2'-dihydroxy-4,4'-dimethoxybenzophenone,
2,2',4,4'-tetrahydroxybenzophenone,
2-hydroxy-4-methoxybenzophenone-5-sulfonic acid,
2-hydroxy-4-octoxybenzophenone, bis-(2-methoxy-4-hydroxy-5-benzoylphenyl)-methane,
2-[2'-hydroxy-3',5'-di-t-amylphenyl]-benzophenone,
2-hydroxy-4-dodecyloxy-benzophenone (trade name: Seasorb 103, mfd. by Sipro Kasei),
2-hydroxy-4-octadecyloxybenzophenone,
2,2'-dihydroxy-4-methoxybenzophenone,
2-hydroxy-4-benzyloxybenzophenone,
2-[2'-hydroxy-3',5'-di-t-amylphenyl]-benzophenone and the like benzophenone ultraviolet ray absorbents,
phenyl salicylate,
para-t-butylphenyl salicylate,
paraoctylphenyl salicylate,
2,4-di-t-butylphenyl-4-hydroxy benzoate,
1-hydroxy benzoate,
1-hydroxy-3-t-butyl-benzoate,
1-hydroxy-3-t-octyl benzoate, resorcinol monobenzoate and the like salicylic acid ultraviolet ray absorbents, ethyl-2-cyano-3,3'-diphenylacrylate, 2-ethylhexyl-2-cyano-3,3'-diphenylacrylate, 2-ethylhexyl-2-cyano-3-phenylcinnate and the like cyanoacrylate ultraviolet ray absorbent, 2-[5-t-butyl-2-hydroxyphenyl]-benzotriazole [trade name: Tinuvin-PS, mfd. by Ciba-Geigy], 2-[5-methyl-2-hydroxyphenyl]-benzotriazole, 2-[2-hydroxy-3,5-bis(α,α-dimethylbenzyl)phenyl]-2H-benzotriazole, 2-[3,5-di-t-butyl-2-hydroxyphenyl]-benzotriazole, 2-[3-t-butyl-5-methyl-2-hydroxyphenyl]-5-chlorobenzotriazole, 2-[3,5-di-t-butyl-2-hydroxyphenyl]-5-chlorobenzotriazole, 2-[3,5-di-t-amyl-2-hydroxyphenyl]-benzotriazole [trade name: Tinuvin-328, mfd. by Ciba-Geigy], methyl-3-[3-t-butyl-5-(2H-benzotriazol-2-yl)-4-hydroxyphenyl]propionate-polyethylene glycol 300 (molecular weight) [trade name: Tinuvin 1130, mfd. by Ciba-Geigy], 2-[3-dodecyl-5-methyl-2-hydroxyphenyl]-benzotriazole methyl-3-[3-(2H-benzotriazol-2-yl)-5-t-butyl-4-hydroxyphenyl]propionate-polyethylene glycol 300, 2-[3-t-butyl-5-propyloctylate-2-hydroxyphenyl]-5-chlorobenzotriazole, 2-[2-hydroxyphenyl-3,5-di-(1,1'-dimethylbenzyl)phenyl]-2H-benzotriazole, 2-[2-hydroxy-5-t-octylphenyl]-2H-benzotriazole, 2-[3-t-butyl-5-octyloxycarbonylethyl-2-hydroxyphenyl]-benzotriazole [trade name: Tinuvin 384, mfd. by Ciba-Geigy], 2-[2-hydroxy-5-tetraoctylphenyl]-benzotriazole, 2-[2-hydroxy-4-octoxy-phenyl]-benzotriazole, 2-[2'-hydroxy-3'-(3",4",5",6"-terahydrophthalimidomethyl)-5'-methylphenyl]-benzotriazole, 2-[2-hydroxy-5-t-butylphenyl]-benzotriazole and the like benzotriazole ultraviolet ray absorbents, and ethanediamido-N-(2-ethoxyphenyl)-N'-(4-isododecylphenyl), 2,2,4,4-tetramethyl-20-(β-lauryl-oxycarbonyl)-ethyl-7-oxa-3,20-diazodispiro(5,1,11,2)heneicosan-21-one and the like oxalic acid anilide ultraviolet ray absorbents.

As the light-shading pigment, a metallic luster pigment having a particle diameter of from 5 to 400 μm or transparent titanium dioxide, transparent iron oxide, transparent cerium oxide, transparent zinc oxide and the like having a particle diameter of 1 μm or less can be exemplified, and one or two or more of them can be employed.

As the aforementioned metallic luster pigment, those in which a core material selected from natural mica, synthetic mica, glass and alumina is covered with a metal oxide can be exemplified, and metallic luster tone color change can be visualized by the synergistic action of the rainbow color effect and transmission effect generated by the selective interference action of visible light with the visible light reflection effect of the photochromic layer.

When the aforementioned light-shading pigment is employed, since it has two-sidedness of both light absorption (or light reflection) function and light transmission function, it absorbs or reflects at least a portion of ultraviolet rays and visible light, can transmit visible light in an appropriate quantity which does not hinder visible sense and can effect perspective observation of color changes in the photochromic layer.

In this connection, a layer containing an ultraviolet ray absorbent can be arranged in a laminated layer state on the upper layer or lower layer of a layer containing the aforementioned light-shading pigment. Also, a coexisting layer can be formed by blending a light-shading pigment and an ultraviolet ray absorbent at an optional ratio.

In addition, a visible light irradiator equipped with a lamp, light emitting diode or the like light source whose main emission range is in the visible light can also be used as the aforementioned color-changing means.

The aforementioned color-changing means is arranged on a toy element equipped with the photochromic layer under a contacted or non-contacted condition. Illustratively, a state in which its entire face is contacted with the toy element, a state in which a part thereof is contacted, a state in which its entire portion is not contacted, a state in which it is contacted after removing a part where a rapping image is formed, a state in which it covers the periphery of a toy element in a non-contacted manner, and the like can be exemplified.

EXAMPLES

A construction in which it has a toy element equipped with a specified photochromic layer and has a specified color-changing means, wherein both of them are arranged in such a specified manner that the coloring state and decolorizing state are alternately formed, memorized and maintained, is effective, and toys of the invention are not limited to those shown in the following examples.

Example 1 cf. FIG. 1

Preparation of Toy Element

Using a screen printing ink containing a diaryl ethene photochromic compound A (1,2-bis(2,4-dimethyl-5-phenyl-3-thienyl)-3,3,4,4,5,5-hexa fluorocyclopentene) which reversibly changes color from colorless to blue, two or more of a heart pattern (photochromic layer) were screen-printed on the surface of a pink polyester tricot fabric, and then a dress for doll (toy element 2) in a one-piece dress form was prepared by cutting and sewing the fabric.

Preparation of Color-Changing Means

Separately from this, a coat for doll (color-changing means 3) was prepared using a colorless and transparent soft polyvinylchloride film having the ability to absorb ultra violet rays.

Preparation of Alternately Color-memorizing Photochromic Toy

An alternately color-memorizing photochromic toy 1 was obtained by fitting a toy with the aforementioned dress for doll and simultaneously combining it with the coat for doll.

When the coat for doll was applied to the aforementioned doll under such a condition that it covered the one-piece dress, the pink one-piece dress was visualized through the coat (A), but when it was exposed to sunlight by taking off its coat, a purple heart pattern (photochromic layer 21) was developed on the one-piece dress caused by ultraviolet rays contained in the sunlight, and the aforementioned heart pattern maintained the condition without causing decolorization when left on any one of the outdoor, indoor and dark places (B).

Next, when the doll under the condition of developing the aforementioned heart pattern was put on the coat over the dress and exposed to sunlight, the ultraviolet rays contained in sunlight were blocked by the coat and the heart pattern was exposed to other light (visible light), so that the purple heart pattern was decolorized, the dress was returned to the original pink color and this state was maintained inside the room (A).

Also, this condition was able to be maintained when left on the outdoor under a condition of wearing the coat.

Since the dress for doll has a function to alternately memorize colors of the plain cloth and heart pattern by repeating the aforementioned process, it was able to play a game many times repeatedly.

Figure 2:
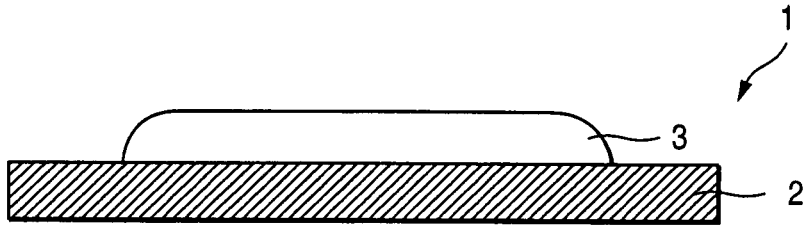
FIG. 2 is a vertical sectional explanatory drawing showing an embodiment of the alternately color-memorizing photochromic toy of the invention.

Example 2 cf. FIG. 2

Preparation of Toy Element

A microcapsule pigment was prepared by mixing a diaryl ethene photochromic compound A (1,2-bis(2,4-dimethyl-5-phenyl-3-thienyl)-3,3,4,4,5,5-hexa fluorocyclopentene) which reversibly changes color from colorless to blue with a diaryl ethene photochromic compound B (1-(2-phenyl-5-methyl-4-thiazoyl)-2-(3-methyl-2-thienyl)-3,3,4,4,5,5-hexafluorocyclopentene) which reversibly changes color from colorless to orange at a ratio of 1:3 and encapsulating the mixture with an epoxy resin membrane by a known interfacial polymerization method, and the pigment was spray-coated on the whole body of a skin-colored doll made of a polyvinyl chloride resin to arrange a photochromic layer, thereby obtaining a doll (toy element 2).

Preparation of Color-changing Means

Separately from this, a water-soluble gel containing an ultraviolet ray absorbent (color-changing means 3) was prepared.

Preparation of alternately color-memorizing photochromic toy

An alternately color-memorizing photochromic toy 1 was obtained by combining the aforementioned toy with the water-soluble gel.

When the aforementioned doll was exposed to sunlight, the photochromic layer developed color by the ultraviolet rays contained in sunlight and changed from skin color to brown, thereby visualizing as if it got a suntan, and this condition was maintained without causing decolorization when left on any one of the outdoor, indoor and dark places.

Next, when the doll was exposed to sunlight after applying the aforementioned water-soluble gel on its surface, the ultraviolet rays contained in sunlight were blocked by the gel and the photochromic layer was exposed to other light (visible light), so that said photochromic layer was gradually decolorized and the doll was returned to the original skin color, and the aforementioned water-soluble gel functioned as if it was a suntan treating gel (FIG. 2).

Also, when the gel adhered to the aforementioned doll was washed off with water, the usual condition of skin color was maintained inside the room.

In addition, when the aforementioned water-soluble gel is partially applied to a skin-colored doll and exposed to sunlight, only the gel-applied portion shows the skin color and the rest becomes brown, so that the aforementioned water-soluble gel can be functioned as if it is a suntan cream.

Since this doll has a function to alternately memorize colors of the skin-colored and suntanned brown states by repeating the aforementioned process, it was able to play a game many times repeatedly.

Figure 3:
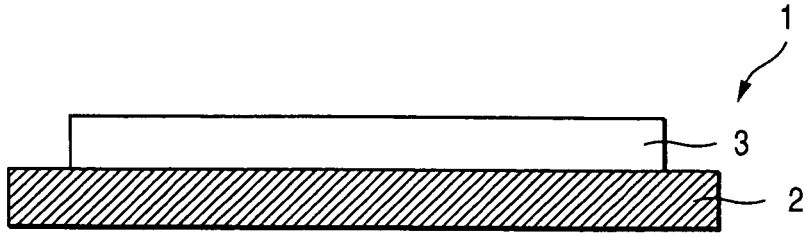
FIG. 3 is a vertical sectional explanatory drawing showing another embodiment of the alternately color-memorizing photochromic toy of the invention.

Example 3 cf. FIG. 3

Preparation of Color-changing Means

A seal (color-changing means 3) was prepared by screen-printing words "I LOVE YOU" with an oil based screen ink containing an ultraviolet ray absorbent on the surface of a transparent polyester pressure sensitive adhesive sheet.

Preparation of Alternately Color-memorizing Photochromic Toy

An alternately color-memorizing photochromic toy 1 was obtained by combining the toy (toy element 2) and water-soluble gel of Example 2 and the aforementioned seal.

When the seal was applied to the aforementioned doll and exposed to sunlight, a portion of the photochromic layer positioning under the layer of words arranged on the sheet did not develop color but the other portions developed color, so that the skin-colored reverse words "I LOVE YOU" appeared on the brown background, and conditions of the aforementioned words was maintained without causing decolorization when left inside the room or in the dark (FIG. 3).

Next, when the doll was exposed to sunlight after peeling off the seal and applying the water-soluble gel on its entire surface, it returned to the original skin color (FIG. 3), and condition was maintained inside the room after washing off the gel with water.

Since the doll has a function to alternately memorize colors of the skin color and suntanned state having reversed words by repeating the aforementioned process, it was able to play a game many times repeatedly.

Figure 4:
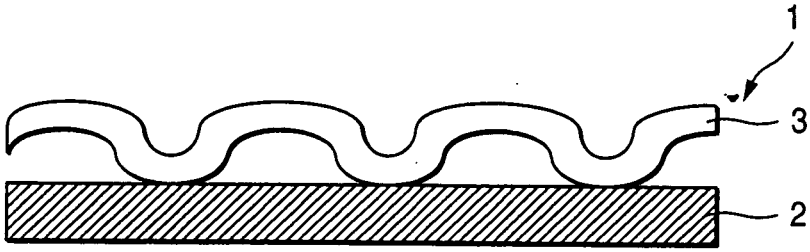
FIG. 4 is a vertical sectional explanatory drawing showing still another embodiment of the alternately color-memorizing photochromic toy of the invention.

Example 4 cf. FIG. 4

Preparation of Toy Element

Using a paint containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method and another paint containing a microcapsule pigment prepared by encapsulating a diaryl ethene photochromic compound D (1,2-bis(2-methyl-6-nitro-3-benzothienyl)-3,3,4,4,5,5-hexafluorocyclopentene) which reversibly changes color from colorless to green with an epoxy resin by a known interfacial polymerization method, they were spray-coated on the eyelids, cheeks, lips and forehead of the face of a doll made of a polyvinyl chloride resin to arrange a photochromic layer, thereby obtaining a doll (toy element 2).

Preparation of Color-changing Means

Separately from this, a mask (color-changing means 3) was prepared using a colorless and transparent soft polyvinyl chloride film having the ability to absorb ultraviolet rays.

Preparation of Alternately Color-memorizing Photochromic Toy

An alternately color-memorizing photochromic toy 1 was obtained by the combination of the aforementioned doll with the mask.

When the aforementioned doll was exposed to sunlight, the photochromic layer was developed into pink and green caused by ultraviolet rays contained in the sunlight, thus visualizing as if the face was made up for a carnival, and this condition was maintained without causing decolorization when left on any one of the outdoor, indoor and dark places.

When the aforementioned doll was put on the mask and exposed to sunlight, the ultraviolet rays contained in sunlight were blocked by the mask and the other light (visible light) was irradiated to the photochromic layer, so that said photochromic layer was gradually decolorized and returned to the original face color and this state was maintained inside the room after complete returning (FIG. 4).

Since the doll's face has a function to alternately memorize colors of the usual face and the face made up for carnival by repeating the aforementioned process, it was able to play a game many times repeatedly.

Figure 5:
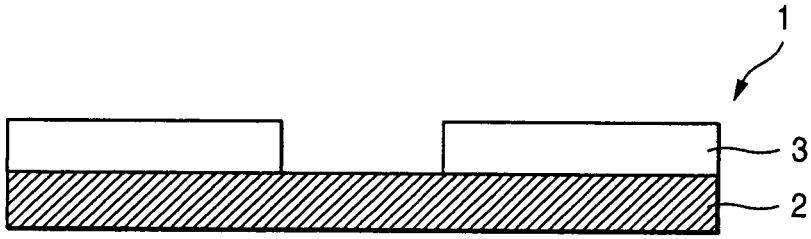
FIG. 5 is a vertical sectional explanatory drawing showing an embodiment of the alternately color-memorizing photochromic toy of the invention.

Example 5 cf. FIG. 5

Preparation of Toy Element

A doll (toy element 2) was prepared by setting hair on the head of a doll using blond-colored nylon filaments (photochromic layer) containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method.

Preparation of Color-changing Means

A stencil sheet prepared by boring a star-shaped hole through a colorless and transparent polyester film having the ability to absorb ultraviolet rays and a hood for covering entire portion of hair with a colorless and transparent soft polyvinyl chloride film having the ability to absorb ultraviolet rays were prepared and used as the color-changing means 3.

Preparation of Alternately Color-memorizing Photochromic Toy

An alternately color-memorizing photochromic toy was obtained by the combination of the aforementioned doll, stencil sheet and hood.

Hair of the aforementioned doll are blond indoor, but when the aforementioned stencil sheet is arranged on the hair and then sunlight is irradiated, a portion of hair where the hole of sheet was arranged changes color from blond to pink caused by ultraviolet rays contained in the sunlight, but the hair covered with the sheet do not change color due to blocking of ultraviolet rays, so that the doll's hair on which a pink star-shaped image was formed on the blond background is visualized. This condition was maintained without causing decolorization when left inside a room or in the dark (FIG. 5).

Next, when the aforementioned hood was put on the doll's head in such a manner that it covered entire hair and then exposed to sunlight, the ultraviolet rays contained in sunlight were blocked by the hood and the other light (visible light) was irradiated, so that the pink color-developed portion of hair was gradually decolorized and returned to blond, and this state was maintained inside the room after the complete returning.

Since the doll's hair have a function to alternately memorize colors of the usual blond and the pink star-shaped pattern on the blond background by repeating the aforementioned process, it was able to play a game many times repeatedly.

Figure 6:
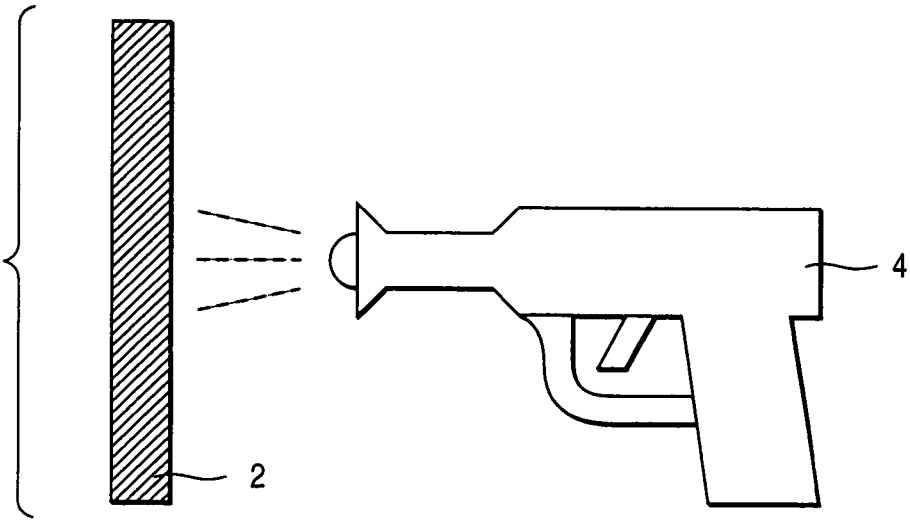
FIG. 6 is a vertical sectional explanatory drawing of an alternately color-memorizing photochromic toy changed to a colored state by ultraviolet rays irradiated by an ultraviolet ray irradiator.

Example 6 cf. FIG. 6

Preparation of Toy Element

Using a paint containing a microcapsule pigment prepared by encapsulating a diaryl ethene photochromic compound E (1-(3-methylbenzothiophen-2-yl)-2-(5-methyl-2-phenyl-4-thiazoyl)-3,3,4,4,5,5-hexafluorocyclopentene) which reversibly changes color from colorless to red with an epoxy resin by a known interfacial polymerization method, a doll (toy element 2) was obtained by spray-coating the paint and thereby arranging a photochromic layer on the entire body of a skin-colored ABS resin doll mimicking a soldier.

Preparation of Color-changing Means

A cylindrical chamber made of a colorless and transparent acrylic resin having the ability to absorb ultraviolet rays (color-changing means) was prepared.

Preparation of Alternately Color-memorizing Photochromic Toy

An alternately color-memorizing photochromic toy was obtained by the combination of the aforementioned doll and chamber.

When an ultraviolet ray lamp and a light source were built into the plastic main body having imitation wrapping of arms on the face and body of the aforementioned doll and then ultraviolet rays were irradiated from a weapon which can irradiate ultraviolet rays from its tip part by pressing a switch, the photochromic layer of the irradiated part changed from colorless to red by the ultraviolet rays so that the irradiated part became a state as if it received a cut, and this condition was maintained without causing decolorization when left in a room or in the dark (FIG. 6).

Next, when the doll was put into the aforementioned chamber and exposed to sunlight, the ultraviolet rays contained in sunlight were blocked by the chamber and the other light (visible light) was irradiated, so that the red color-developed part of the doll was gradually decolorized and returned to the skin color and this state was maintained inside the room or in the dark without decolorization.

Since the doll has a function to alternately memorize colors of the skin-colored sturdy state and the red-colored wounded state by repeating the aforementioned process, it was able to play a game many times repeatedly.

Figure 7:
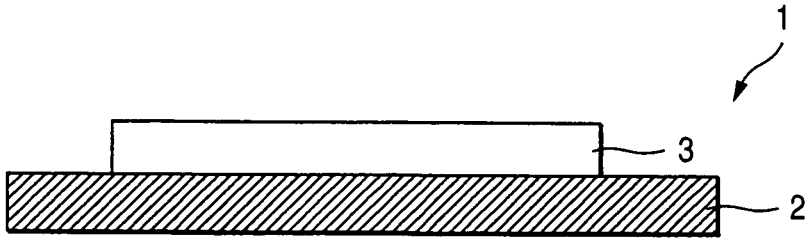
FIG. 7 is a vertical sectional explanatory drawing showing an embodiment of the alternately color-memorizing photochromic toy of the invention.

Example 7 cf. FIG. 7

Preparation of Toy Element

Using a paint containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method and also containing a general yellow dye (reversibly changes from yellow to red), a miniature car (toy element 2) was obtained by spray-coating the paint on the surface of a white ABS resin miniature car and thereby arranging a photochromic layer thereon.

Preparation of Color-changing Means

Using an oil based screen ink in which an ultraviolet ray absorbent has been dissolved, a transparent sheet prepared by screen-printing negative designs of a number, a flame and a skull on a colorless and transparent polyester film (color-changing means) and a garage shape container formed from a colorless and transparent acrylic resin having the ability to absorb ultraviolet rays (color-changing means 3) were prepared.

Preparation of Alternately Color-memorizing Photochromic Toy

An alternately color-memorizing photochromic toy 1 was obtained by the combination of the aforementioned miniature car and transparent sheet.

Though the aforementioned miniature car is yellow in the room, when the aforementioned transparent sheet is arranged on the body and exposed to sunlight, the parts printed on the sheet do not change color because ultraviolet rays are blocked, while the photochromic layer of the un-printed parts changes to red due to the ultraviolet rays contained in sunlight, so that the designs of red number, flame and skull appeared on the yellow background, and this conditions were maintained without causing decolorization when left indoor or in the dark (FIG. 7).

Next, when the aforementioned miniature car was put into the aforementioned container and exposed to sunlight, the ultraviolet rays contained in sunlight were blocked by the container and the other light (visible light) was irradiated, so that the red designs were gradually decolorized and returned to yellow, and this state was maintained without causing decolorization when left indoor or in the dark. Also, this condition was able to be maintained even when left on the outdoor under a condition of putting into the container.

Since the miniature car has a function to alternately memorize colors of the yellow-colored state and the state in which red designs appeared on the yellow background by repeating the aforementioned process, it was able to play a game many times repeatedly.

Figure 8:
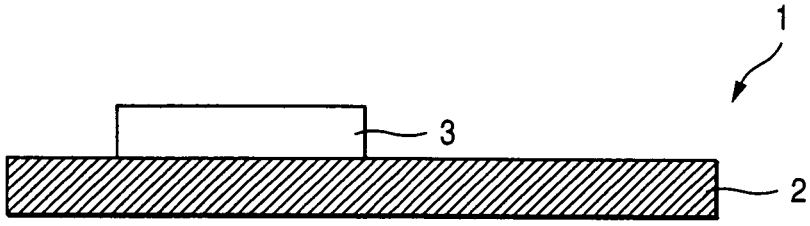
FIG. 8 is a vertical sectional explanatory drawing showing another embodiment of the alternately color-memorizing photochromic toy of the invention.

Example 8 cf. FIG. 8

Preparation of Alternately Color-memorizing Photochromic Toy

A learning tool (toy element 2) was prepared by printing a picture of apple and a word "APPLE" on a sheet of coated paper using a non-chromic ink and further screen-printing a word "APPLE" (photochromic layer) on a position adjacent to the aforementioned word "APPLE" using a screen printing ink containing a diaryl ethene photochromic compound F (1-(2-methyl-5-(4-methylphenyl)-3-thienyl)-2-(2,4-dimethyl-5-(4-methylphenyl)-3-thienyl)-3,3,4,4,5,5-hexafluorocyclopentene) which reversibly changes color from colorless to blue.

Using a rectangular sheet prepared by cutting a colorless and transparent polyester film having the ability to absorb ultraviolet rays (color-changing means 3), an alternately color-memorizing photochromic learning toy 1 was obtained by fixing a side of said sheet on a position adjacent to the aforementioned word "APPLE" on the coat paper in such a construction that the word "APPLE" was covered with the sheet by reversing the sheet using the fixed part as the supporting point, or not covered.

The word "APPLE" of the aforementioned learning tool was not visualized under such a condition that the sheet was arranged on the upper side, but when it was exposed to sunlight by turning over the sheet, the photochromic layer changed to blue caused by ultraviolet rays contained in the sunlight so that the word "APPLE" appeared, and this state was maintained without causing decolorization when left on any one of the outdoor, indoor and dark places.

Next, when the sheet was again arranged on the word "APPLE" and exposed to sunlight, the ultraviolet rays contained in sunlight were blocked by the sheet and the other light (visible light) was irradiated, so that the word "APPLE" was gradually decolorized and became invisible, and this state was maintained without causing decolorization when left on any one of the outdoor, indoor and dark places.

Since it has a function to alternately memorize colors of the states under which the word "APPLE" was visualized and not visualized by repeating the aforementioned process, it was able to play a game many times repeatedly.

Figure 9:
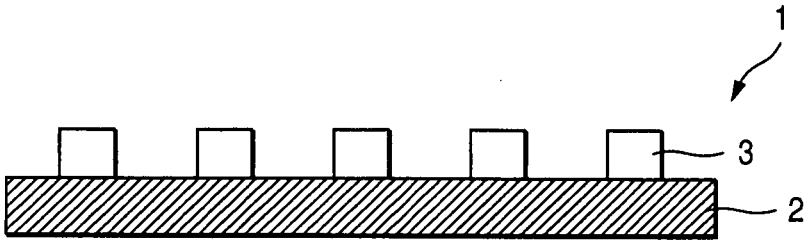
FIG. 9 is a vertical sectional explanatory drawing showing still another embodiment of the alternately color-memorizing photochromic toy of the invention.

Example 9 cf. FIG. 9

Preparation of Toy Element

Using a paint containing a microcapsule pigment prepared by encapsulating a diaryl ethene photochromic compound F (1-(2-methyl-5-(4-methylphenyl)-3-thienyl)-2-(2,4-dimethyl-5-(4-methylphenyl)-3-thienyl)-3,3,4,4,5,5-hexafluorocyclopentene) which reversibly changes color from colorless to blue with an epoxy resin by a known interfacial polymerization method and also containing a fluorescent pink pigment, a cubic material (toy element 2) was obtained by spray-coating the paint on the surface of a formed product having a shape of a bear formed from a pink polyvinyl chloride resin and thereby arranging a photochromic layer thereon.

Preparation of Color-changing Means

A marking pen prepared by impregnating an occluding material with a water-soluble ink containing an ultraviolet ray absorbent and putting the aforementioned occluding material into a cylindrical holder (color-changing means 3) and a case made of a colorless and transparent acrylic resin having the ability to absorb ultraviolet rays were prepared.

Preparation of Alternately Color-memorizing Photochromic Toy

An alternately color-memorizing photochromic toy 1 was obtained by the combination of the aforementioned cubic material and marking pen.

When a desired pattern was formed on the aforementioned cubic material using the marking pen and then exposed to sunlight, the pattern-formed part was not decolorized due to blocking of ultraviolet rays and the other parts changed to purple caused by ultraviolet rays contained in the sunlight so that a pink pattern appeared on the purple background, and this condition was maintained without causing decolorization when left indoor or in the dark (FIG. 9).

Next, when the cubic material was put into the case after washing off handwriting on the pattern portion and then exposed to sunlight, the ultraviolet rays contained in sunlight were blocked by the sheet and the other light (visible light) was irradiated, so that the colored part was gradually decolorized and returned to the pink color and this state was maintained without causing decolorization when left indoor or in the dark. Also, this condition was able to be maintained when left on the outdoor under a condition of putting into the case.

Since the cubic material has a function to alternately memorize colors of the state of pink color and the stated under which a desired pattern was formed on the purple background by repeating the aforementioned process, it was able to play a game many times repeatedly.

Figure 10:
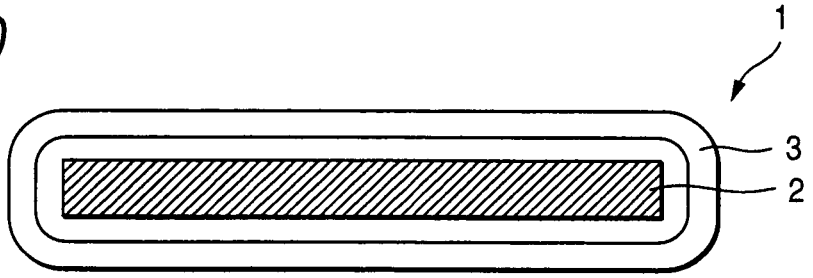
FIG. 10 is a vertical sectional explanatory drawing showing an embodiment of the alternately color-memorizing photochromic toy of the invention.

Example 10 cf. FIG. 10

Preparation of Toy Element

By preparing polyacrylonitrile fibers containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method, and by making them into slivers, a high pile fabric having a pile length of 15 mm was prepared using a high pile knitting machine and subjected to a sewing room operation to obtain a large stuffed dog (toy element 2).

Preparation of color-changing means

A dog house (color-changing means 3) was prepared using a colorless and transparent acrylic resin having the ability to absorb ultraviolet rays.

Preparation of Alternately Color-memorizing Photochromic Toy

An alternately color-memorizing photochromic toy 1 was obtained by the combination of the aforementioned stuffed dog and dog house.

The aforementioned stuffed dog was white inside the room, but when it was exposed to sunlight, it changed to pink caused by ultraviolet rays contained in the sunlight, and this condition was maintained without causing decolorization when left on any one of the outdoor, indoor and dark places.

Next, when the aforementioned pink-colored stuffed dog was put into the dog house and exposed to sunlight, the ultraviolet rays contained in sunlight were blocked by the dog house, and the stuffed dog was exposed to the other light (visible light), so that the stuffed dog was decolorized and returned to the original white color, and this state was maintained inside the room. Also, this condition was able to be maintained when left on the outdoor under a condition of putting into the dog house (FIG. 10).

Since the stuffed dog has a function to alternately memorize colors of white and pink by repeating the aforementioned process, it was able to play a game many times repeatedly.

Figure 11:
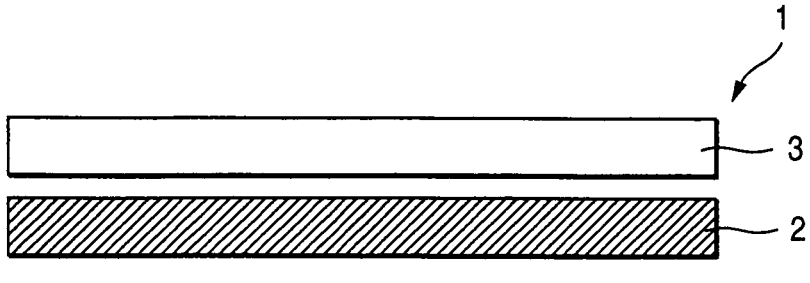
FIG. 11 is a vertical sectional explanatory drawing showing an embodiment of the alternately color-memorizing photochromic toy of the invention.

Example 11 cf. FIG. 11

Preparation of Toy Element

Using an aqueous spraying paint containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method, a spotted design was spray-coated on a stuffed cat obtained by cutting and sewing a plush constituted from a light blue modacrylic fibers (pile length of 10 mm), thereby arranging a photochromic layer, and then the cat was dried and brushed to obtain a stuffed cat (toy element 2).

Preparation of Color-changing Means

A coat for cat use (color-changing means 3) was prepared using a colorless and transparent soft polyvinyl chloride resin having the ability to absorb ultraviolet rays.

Preparation of Alternately Color-memorizing Photochromic Toy

An alternately color-memorizing photochromic toy 1 was obtained by the combination of the aforementioned stuffed cat and coat.

The aforementioned stuffed cat was generally light blue inside the room, but when it was exposed to sunlight, a purple spotted design appeared caused by ultraviolet rays contained in the sunlight, and the aforementioned spotted design was maintained without causing decolorization when left on any one of the outdoor, indoor and dark places.

Next, when the spotted design-developed stuffed cat was dressed with the coat and exposed to sunlight, the ultraviolet rays contained in sunlight were blocked by the coat, and the spotted design was exposed to the other light (visible light), so that the purple spotted design was decolorized and the stuffed cat returned to the original light blue, and this state was maintained inside the room. Also, this condition was able to be maintained when left on the outdoor under a condition of dressing in the coat (FIG. 11).

Since the stuffed cat has a function to alternately memorize colors of plain color and spotted design by repeating the aforementioned process, it was able to play a game many times repeatedly.

Figure 12:
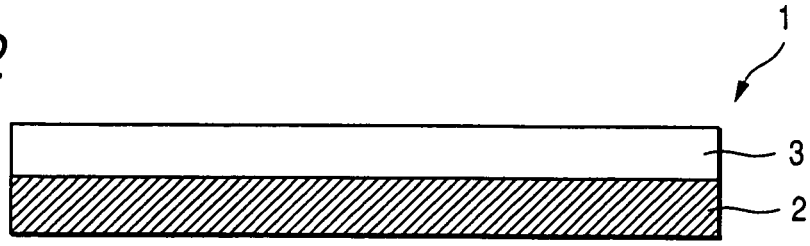
FIG. 12 is a vertical sectional explanatory drawing showing an embodiment of the alternately color-memorizing photochromic toy of the invention.

Example 12 cf. FIG. 12

Preparation of Alternately Color-memorizing Photochromic Toy

A non-chromic layer was arranged on the entire area of a 30 cm×40 cm white base paper by process-printing a picture of a snow-covered mountain and a plain of dry grass using a yellow ink, a magenta ink, a cyan ink and a black ink.

Using a screen printing ink containing a microcapsule pigment prepared by encapsulating a diaryl ethene photochromic compound C (1,2-bis(5-methyl-2-phenyl-4-thiazoyl)-3,3,4,4,5,5-hexafluorocyclopentene) which reversibly changes color from colorless to pink with an epoxy resin by a known interfacial polymerization method, a screen printing ink containing a microcapsule pigment prepared by encapsulating a diaryl ethene photochromic compound D (1,2-bis(2-methyl-6-phenyl-3-benzothienyl)-3,3,4,4,5,5-hexafluorocyclopentene) which reversibly changes color from colorless to green with an epoxy resin by a known interfacial polymerization method and a screen printing ink containing a microcapsule pigment prepared by encapsulating a diaryl ethene photochromic compound B (1-(2-phenyl-5-methyl-4-thiazoyl)-2-(3-methyl-2-thienyl)-3,3,4,4,5,5-hexafluorocyclopentene) which reversibly changes color from colorless to orange with an epoxy resin by a known interfacial polymerization method, a photochromic layer was arranged on the aforementioned non-chromic layer by screen-printing leaves on the snow-covered mountain part and a flower bed of pink and orange flowers and green stems and leaves on the plain part (photochromic layer).

An alternately color-memorizing jigsaw puzzle (toy element 2) was prepared from the base paper on which the aforementioned non-chromic layer and photochromic layer had been arranged, by cutting it into two or more puzzle pieces.

Preparation of Color-changing Means

Separately from this, a sheet (color-changing means 3) was prepared cutting a colorless and transparent polyester film having the ability to absorb ultraviolet rays into a rectangular shape having a slightly larger size than the size of the jigsaw puzzle.

Preparation of Alternately Color-memorizing Layer Toy

An alternately color-memorizing photochromic toy 1 was obtained by the combination of the aforementioned jigsaw puzzle and sheet.

According to the aforementioned puzzle, the picture of a snow-covered mountain and a plain of dry grass was visualized when the puzzle was completed as such, but when it was exposed to sunlight, the photochromic layer was changed to pink, orange and green caused by ultraviolet rays contained in the sunlight, so that the picture of a flower bed of pink and orange flowers and green leaves and stems appeared on the plain of dry grass, and this condition was maintained without causing decolorization when left on any one of the outdoor, indoor and dark places.

Next, when the aforementioned sheet was arranged on the jigsaw puzzle and exposed to sunlight, the ultraviolet rays contained in sunlight were blocked by the sheet and the other light (visible light) was irradiated, so that the picture of the leaves and the flowers, leaves and stems of flower bed was gradually decolorized and became invisible, and this condition was maintained without causing decolorization when left on any one of the outdoor, indoor and dark places (FIG. 12).

Since it has a function to alternately memorize colors of a visualized state of a picture of a mountain overgrown with leaves and a colorful flower bed and of a state of snow-covered mountain and a plain of dry grass, by repeating the aforementioned process, it was able to play a game many times repeatedly.

Figure 13:
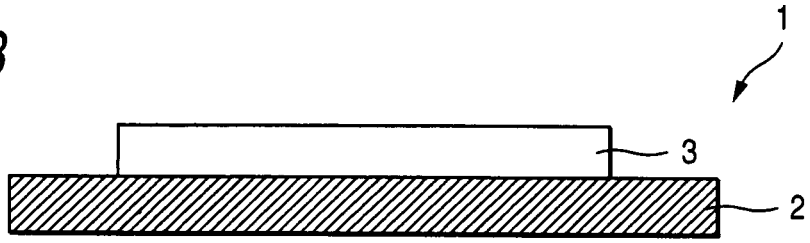
FIG. 13 is a vertical sectional explanatory drawing showing an embodiment of the alternately color-memorizing photochromic toy of the invention.

Example 13 cf. FIG. 13

A sheet-shaped color-changing means 3 was prepared by the same method of Example 7, except that the ultraviolet ray absorbent used in the color-changing means of Example 7 was changed to a metallic luster pigment called pearl pigment (trade name: Iriodin 219, mfd. by Merck Japan) in which the surface of natural mica was coated with titanium oxide, and combined with the toy element of Example 7 to constitute an alternately color-memorizing photochromic toy 1.

Though the aforementioned toy element 2 (miniature car) was yellow in the room, when the aforementioned transparent sheet was arranged on the body and exposed to sunlight, the parts printed on the sheet did not change color because ultraviolet rays were blocked, while the photochromic layer of the un-printed parts changed to red due to the ultraviolet rays contained in sunlight, so that the designs of red number, flame and skull appeared on the yellow background, and this conditions were maintained without causing decolorization when left indoor or in the dark (FIG. 13).

Next, when the aforementioned miniature car was put into the aforementioned container and exposed to sunlight, the ultraviolet rays contained in sunlight were blocked by the container and the other light (visible light) was irradiated, so that the red designs were gradually decolorized and returned to yellow, and this state was maintained without causing decolorization when left indoor or in the dark.

Also, this condition was able to be maintained even when left on the outdoor under a condition of putting into the container. Since the miniature car has a function to alternately memorize colors of the yellow-colored state and the state in which red designs appeared on the yellow background by repeating the aforementioned process, it was able to play a game many times repeatedly.

Figure 14:
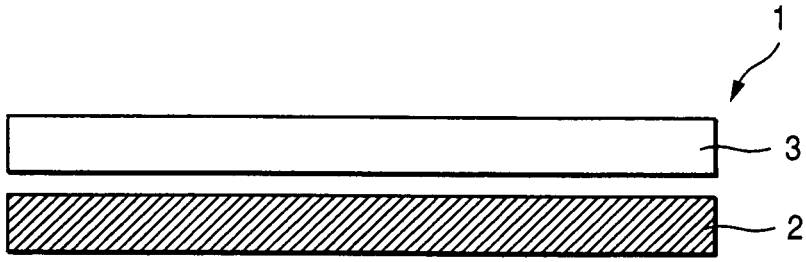
FIG. 14 is a vertical sectional explanatory drawing showing an embodiment of the alternately color-memorizing photochromic toy of the invention.

Example 14 cf. FIG. 14

Preparation of Toy Element

Using a screen printing ink containing a diaryl ethene photochromic compound C (1,2-bis(5-methyl-2-phenyl-4-thiazoyl)-3,3,4,4,5,5-hexafluorocyclopentene) which reversibly changes color from colorless to pink, a one-piece dress for doll (toy element 2) was prepared by screen-printing two or more spotted designs (photochromic layer) on the surface of a blue polyester tricot fabric and then cutting and sewing the fabric.

Preparation of Color-changing Means

Separately from this, a coat for doll (color-changing means 3) was prepared by fixing a binder resin containing an ultraviolet ray absorbent on the surface of a cloth obtained by using transparent single yarn and transparent yarn as the warp and the weft respectively.

Preparation of Alternately Color-memorizing Photochromic Toy

An alternately color-memorizing photochromic toy 1 was obtained by fitting a toy with the aforementioned dress for doll and simultaneously combining it with the coat for doll.

When the coat for doll was applied to the aforementioned doll under such a condition that it covered the one-piece dress, the blue one-piece dress was visualized through the coat, but when it was exposed to sunlight by taking off its coat, a purple spotted design was developed on the one-piece dress caused by ultraviolet rays contained in the sunlight, and this condition of the aforementioned spotted design was maintained without causing decolorization when left on any one of the outdoor, indoor and dark places.

Next, when the doll under the condition of developing the aforementioned spotted design was put on the coat over the dress and exposed to sunlight, the ultraviolet rays contained in sunlight were blocked by the coat and the spotted design was exposed to other light (visible light), so that the purple spotted design was decolorized and the dress was returned to the original blue color, and this state was maintained inside the room. Also, this condition was able to be maintained when left on the outdoor under a condition of wearing the coat.

Since the dress for doll has a function to alternately memorize colors of the plain cloth and spotted design by repeating the aforementioned process, it was able to play a game many times repeatedly.

Figure 15:
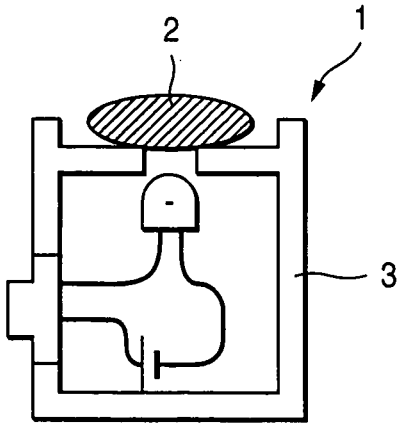
FIG. 15 is a vertical sectional explanatory drawing showing an embodiment of the alternately color-memorizing photochromic toy of the invention.

Example 15 cf. FIG. 15

Using a paint containing a pigment prepared by dispersing in a resin a diaryl ethene photochromic compound G (1-(5-methyl-2-phenyl-4-thiazoyl)-2-(3-methylbenzothiophen-2-yl)-3,3,4,4,5,5-hexafluorocyclopentene) which reversibly changes color from colorless to orange, an accessory (toy element 2) was prepared by spray-coating the paint on the surface of a transparent jewel toy and thereby arranging a photochromic layer thereon.

Preparation of Color-changing Means

Separately from this, a display capable of emitting light from the upper part of its container (color-changing means 3) was prepared by putting an ultraviolet ray emitting diode, a light emitting diode whose main light emitting region is visible light and a power source in a container and also putting therein a device capable of selectively irradiating the light source of each diode by a switch.

Preparation of Alternately Color-memorizing Photochromic Toy

An alternately color-memorizing photochromic toy 1 was obtained by the combination of the aforementioned accessory and display.

When the aforementioned accessory was applied to the display and then light was irradiated from the ultraviolet ray emitting diode by operating the switch, the accessory was changed to orange and the aforementioned condition was maintained without causing decolorization when left on any one of the outdoor, indoor and dark places.

Next, when the aforementioned accessory changed to orange was again applied to the display and then light was irradiated from the light emitting diode whose main light emitting region is visible light by operating the switch, the accessory was changed to colorless and this state was maintained inside the room.

Since the accessory has a function to alternately memorize colors of orange and colorless states by repeating the aforementioned process, it was able to play a game many times repeatedly.

While conventional photochromic toys are possessed of a characteristic in that they change color by the irradiation of sunlight and return to the original color spontaneously and alternately when left on a place where they are not exposed to sunlight, the photochromic toy of the invention has a characteristic nature of expressing a function to alternately memorize and maintain coloring state and decolorizing state, which is effected by employing a specified photochromic compound as a photochromic material and arranging a specified color-changing means on a specified position, and thereby effecting expression of the characteristics of the aforementioned photochromic compound effectively as toy use, and also has properties as toys and various applicability and developing ability as toys.

What is claimed is:

1. A method for alternately expressing a color-memorizing photochromic function in a toy element, which comprises arranging (1) a color-changing means under a contacted or non-contacted condition, which contains at least one of an ultraviolet ray absorbent and a light-shading pigment capable of shading at least ultraviolet rays, to (2) a toy element comprising a photochromic layer which maintains a coloring state by developing a color through the irradiation of ultraviolet rays or sunlight containing ultraviolet rays and changes into decolorizing state through its decolorization by the irradiation of visible light, wherein the coloring state is visible in well-lighted areas, wherein said color-changing means changes said photochromic layer of the coloring state into decolorizing state by cutting off ultraviolet rays of sunlight and thereby effecting irradiation of visible light, and maintains the changed state, and wherein said photochromic layer contains a diaryl ethene photochromic compound, so as to express a function to memorize and maintain coloring and decolorizing states alternately.

2. An alternately color-memorizing photochromic toy comprising:

a toy element comprising a photochromic layer which contains a diaryl ethene photochromic compound, maintains a coloring state by developing a color through the irradiation of ultraviolet rays or sunlight containing ultraviolet rays and changes into decolorizing state through its decolorization by the irradiation of visible light; and a color-changing means which contains at least one of an ultraviolet ray absorbent and a light-shading pigment capable of shading at least ultraviolet rays, changes said photochromic compound of the coloring state into decolorizing state by cutting off ultraviolet rays of sunlight and thereby effecting irradiation of visible light, and maintains the changed state, wherein the coloring state is visible in well-lighted areas, and wherein a function to memorize and maintain coloring and decolorizing states alternately is expressed by arranging said color-changing means under such a condition that it is contacted or non-contacted with said photochromic layer.

3. The alternately color-memorizing photochromic toy according to claim 2, wherein said diaryl ethene photochromic compound is included in microcapsules.

4. The alternately color-memorizing photochromic toy according to claim 2, wherein said photochromic layer is any one of a printing or coating layer, a printing image and a writing image, which contains at least said diaryl ethene photochromic compound and a binder resin.

5. The alternately color-memorizing photochromic toy according to claim 2, wherein said photochromic layer is a molding prepared by integrally blending said diaryl ethene photochromic compound with a thermoplastic resin.

6. The alternately color-memorizing photochromic toy according to claim 2, wherein said color-changing means is a sheet-shaped molding prepared by integrally blending at least one of said ultraviolet ray absorbent and said light-shading pigment capable of shading at least ultraviolet rays with a transparent plastic.

7. The alternately color-memorizing photochromic toy according to claim 6, wherein a rapping image is arranged inside of said sheet-shaped molding.

8. The alternately color-memorizing photochromic toy according to claim 2, wherein said color-changing means is any one of a printing or coating layer, a printing image and a writing image, in which at least one of said ultraviolet ray absorbent and said light-shading pigment capable of shading at least ultraviolet rays is fixed in a dissolved or dispersed state to a binder resin.

9. The alternately color-memorizing photochromic toy according to claim 8, wherein any one of a printing or coating layer, a printing image and a writing image is directly arranged on said photochromic layer of a toy element.

10. The alternately color-memorizing photochromic toy according to claim 8, wherein any one of said printing or coating layer, said printing image and said writing image is arranged on a transparent plastic sheet.

11. The alternately color-memorizing photochromic toy according to claim 2, wherein said color-changing means is in the form of plastic or fluid material in which at least one of said ultraviolet ray absorbent and said light-shading pigment capable of shading at least ultraviolet rays is dissolved or dispersed.

12. The alternately color-memorizing photochromic toy according to claim 2, wherein said color-changing means is a cloth constituted from transparent fibers prepared by fixing at least one of said ultraviolet ray absorbent and said light-shading pigment capable of shading at least ultraviolet rays on the surface or by blending therewith.

13. The alternately color-memorizing photochromic toy according to claim 2, wherein said color-changing means is a visible light irradiator whose main light generation range is in the visible light.

14. The alternately color-memorizing photochromic toy according to claim 2, wherein said coloring state is changed by an ultraviolet ray irradiator which irradiates ultraviolet rays.

15. The alternately color-memorizing photochromic toy according to claim 2, wherein a general purpose dyestuff or pigment is allowed to coexist in said photochromic layer.

* * * * *